United States Patent [19]

Curry et al.

[11] 4,073,037

[45] Feb. 14, 1978

[54] HINGE PINTLE RETAINING MEANS

[75] Inventors: Edward G. Curry; Vernard W. Sanders, both of Los Angeles, Calif.

[73] Assignee: Henry Soss and Company, Los Angeles, Calif.

[21] Appl. No.: 730,340

[22] Filed: Oct. 7, 1976

[51] Int. Cl.[2] ..... E05D 5/12; E05F 1/14; E05F 3/20

[52] U.S. Cl. ..... 16/169; 16/50; 16/189

[58] Field of Search ..... 16/169, 168, 50, 128 R, 16/189, 176

[56] References Cited

U.S. PATENT DOCUMENTS

| | | | |
|---|---|---|---|
| 737,360 | 8/1903 | Daly | 16/169 UX |
| 854,580 | 5/1907 | John | 16/169 X |
| 1,030,801 | 6/1912 | Berault | 16/169 |
| 3,903,567 | 9/1975 | Suska | 16/128 R |
| 3,978,551 | 9/1976 | Mochizuki | 16/50 X |

FOREIGN PATENT DOCUMENTS

| | | | |
|---|---|---|---|
| 124,686 | 4/1919 | United Kingdom | 16/169 |

*Primary Examiner*—James Kee Chi

[57] ABSTRACT

A pair of leaf hinges have respective knuckles in axial alignment providing respective axially aligned chambers for reception of a pintle serving as a pivot for the hinges. The pintle is provided with a keying rib, and grooves in the respective knuckles and are in alignment only when the hinge is rotated to extreme position to permit insertion of the pintle and the keying rib into operative position within the knuckles. When the hinge is installed on a door and the door mounted on a frame, the door can not normally be swung to a position wherein the grooves are in alignment so that the pintle can not be removed from the hinge as long as the door stays in mounted position on the frame.

7 Claims, 8 Drawing Figures

HINGE PINTLE RETAINING MEANS

The conventional way for hanging doors is to make use of two or more leaf type hinges, opposite parts of which are pivotally connected one to the other by a pintle serving as a pivot pin. Customarily a simple pintle is one consisting of a cylindrical shaft which slides into aligned apertures in the hinge knuckles to hold the hinge leaves together, the pintle being provided with a head which engages the upper side of the uppermost knuckle to hold the pintle in position.

On some occasions and particularly on self closing doors the pintle may be of composite construction provided with a torsion spring opposite ends of which act against the respective leaf hinges for automatically swinging the door to closed position.

When the leaf hinges are applied in the customary fashion one hinge leaf is attached to the edge of the door and the other to the door frame in a manner such that when the door is closed the door hinges are concealed. The mounting is such that the knuckles protrude from the face of the door which is usually the inside face when the door is an outside door and it is possible by removing the pintles thereby disengaging one leaf hinge from the other to remove the door from the frame, even though the door may be closed and locked. Consequently, if an unauthorized person is able to obtain access to the interior and the door is key locked from the inside, the door can still be removed permitting the unauthorized person to readily carry things out through the door way.

It is therefor one of the objects of the invention to provide a new and improved leaf hinge and pintle construction of a character such that when the door is closed the pintle cannot be removed. Still another object of the invention is to provide a new and improved leaf hinge and pintle construction of such character that even though the door is opened the pintle cannot be removed and in that way preclude inadvertent dislodgement of the pintle while the door is open for ultimate complete removal after the door has been closed.

Still another object of the invention is to provide a new and improved leaf hinge and pintle assembly of such character that the pintle can be inserted in position only when the leaf hinges are disengaged from the door and door frame so that once the leaf hinges are applied to the door and the frame the pintle cannot be removed until the leaf hinges are actually themselves removed from the door and frame.

Still another object of the invention is to provide a leaf hinge and pintle arrangement of a character such that the pintle cannot be removed from the leaf hinges of a door mounted to swing in the customary fashion, the pintle structure being such that it is adaptable for use on all manner of pintles including those incorporating a compact concealed self-closing spring motor.

With these and other objects in view the invention consists of the construction, arrangement, and combination of the various parts of the device, whereby the objects contemplated are attained, as hereinafter set forth, pointed out in the appended claims and illustrated in the accompanying drawings.

Figure 1:
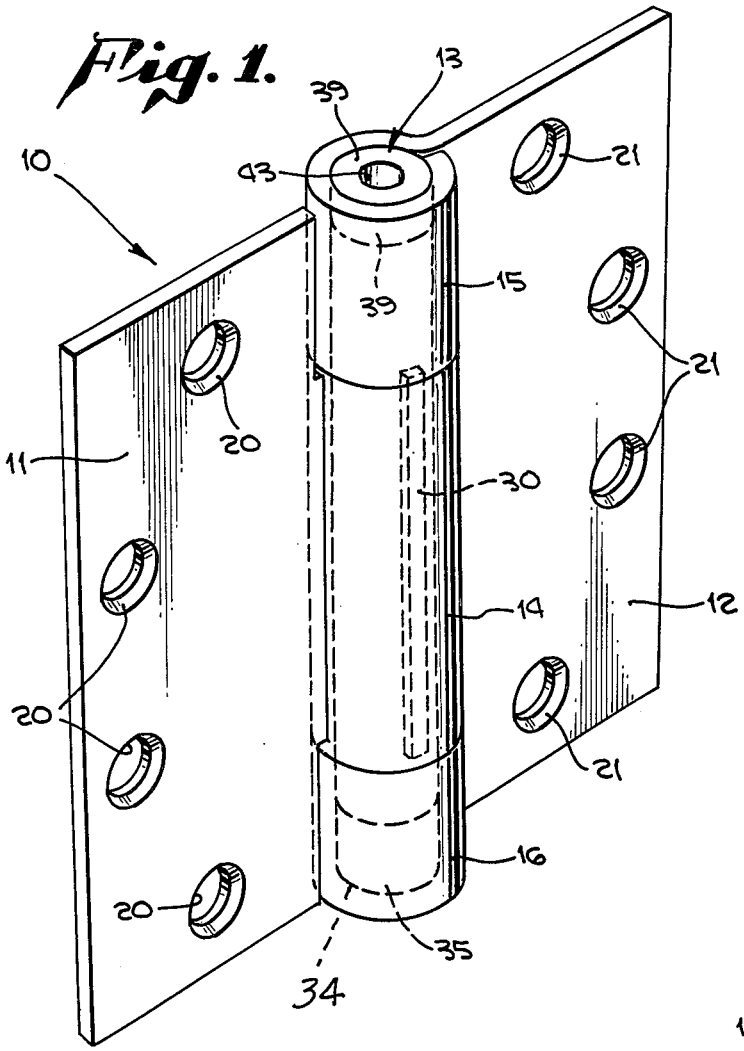
FIG. 1 is a front perspective view of a conventional three knuckle hinge containing the pintle of the invention.

In an embodiment of the invention chosen for the purpose of illustration there is shown a three knuckle hinge indicated generally by the reference character 10 consisting primarily of a male hinge leaf 11, a female hinge leaf 12 and a pintle 13. The male hinge leaf 11 is formed with a single centrally disposed knuckle 14 substantially cylindrical in shape. The female hinge leaf 12 is formed with an upper knuckle 15 and a lower knuckle 16, also substantially cylindrical shaped and in axial alignment with each other and with the centrally disposed knuckle 14. In the knuckle 14 is a chamber 17, which when the leaf hinges are assembled, is in axial alignment with chambers 18 and 19 respectively in the upper and lower knuckles 15 and 16 of the female leaf hinge 12. The chambers are adapted to receive the pintle 13 which holds the leaf hinge parts in rotatable engagement.

Countersunk apertures 20 in the male leaf hinge 11 and similar countersunk apertures 21 in the leaf hinge part 12 are for reception of flat head screws 22. In the embodiment chosen for the purpose of illustration the female leaf hinge 12 is attached to a door frame 23 by means of screws 22 and the male leaf hinge 11 is attached to an edge face 24 of a door 25 also by use of screws 22.

Figure 2:
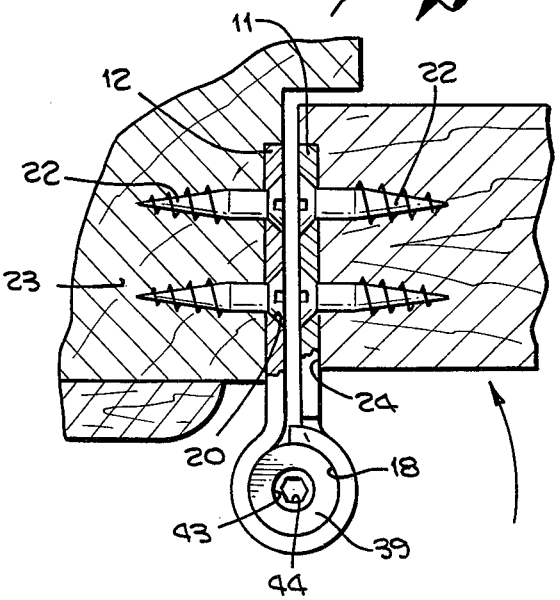
FIG. 2 is a plan view partially broken away showing the hinge of FIG. 1 installed on a door and frame.
Figure 8:
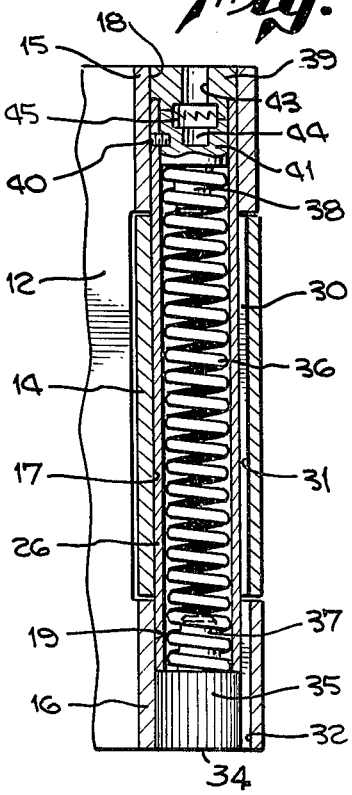
FIG. 8 is a longitudinal sectional view on the line 8—8 of FIG. 6.
Figure 7:
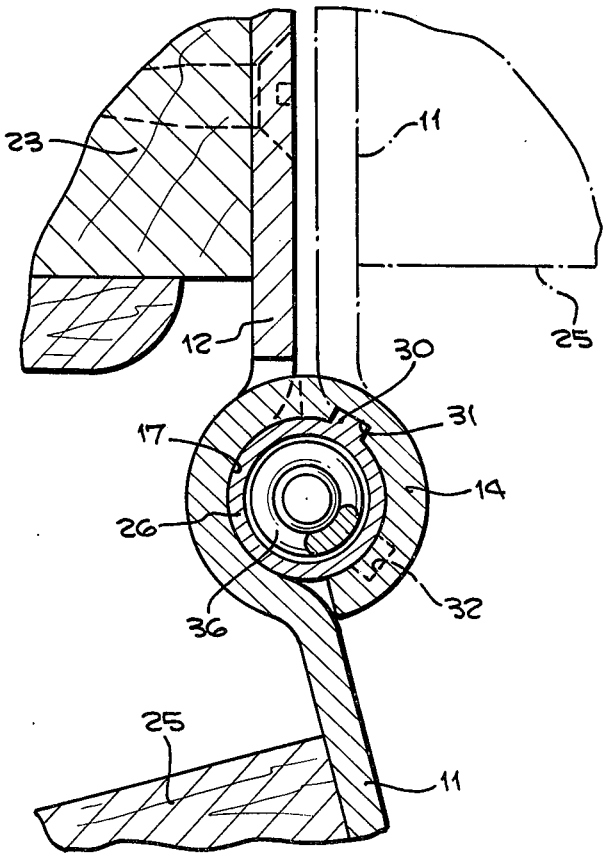
FIG. 7 is a cross sectional view taken at the location of FIG. 6 but showing the door swung to full open position.

In the embodiment shown the door 25 is adapted to rotate about the axis of the pintle 13 from the fully closed position of FIG. 2 to the full open position of FIG. 7.

Figure 3:
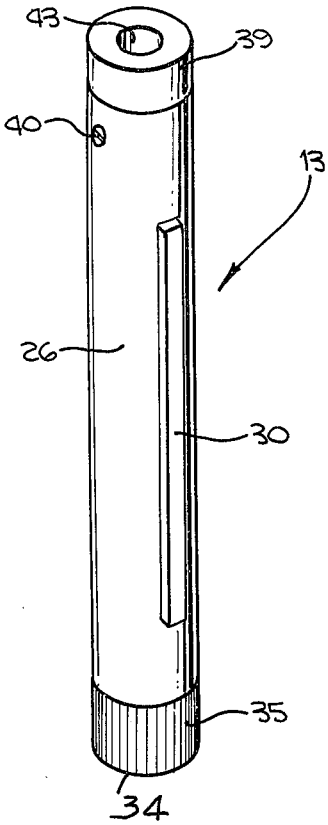
FIG. 3 is a side prospective view of the pintle.

The pintle 13 may if desired, serve as a pivot pin only irrespective of its more composite construction. For that purpose there is provided on a tubular housing 26 which is the central portion of the pintle 13, an elongated projecting rib 30 as shown in FIG. 3 which is substantially rectangular in cross sectional shape. The length of the projecting rib 30 is about the same or slightly less than the length of the central knuckle 14 of the leaf hinge 11.

Figure 4:
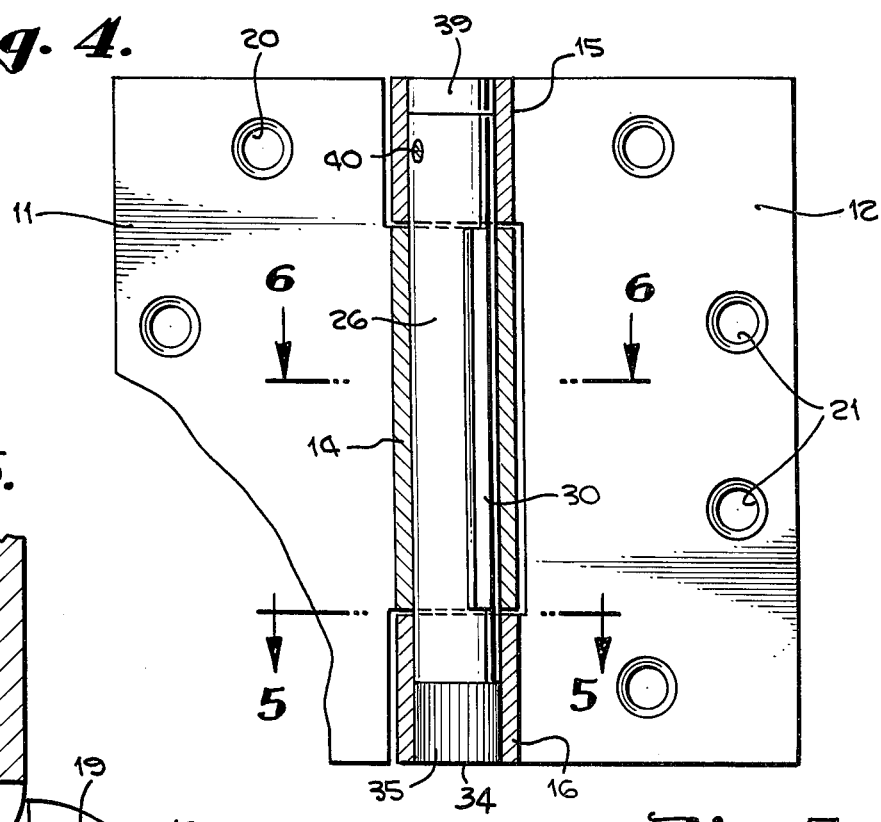
FIG. 4 is a front elevational view of the hinge of FIG. 1 with the knuckles in section revealing the position of the pintle inside.
Figure 6:
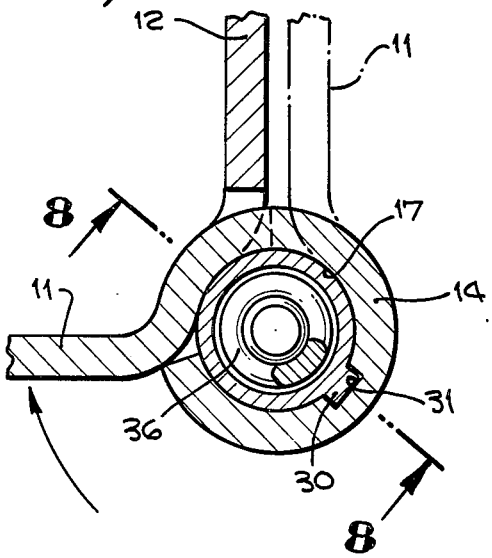
FIG. 6 is a cross sectional view on the line 6—6 of FIG. 4.

In the central knuckle 14, as shown in FIGS. 4, 6 and 7, there is provided a groove 31 which is adapted to receive the rib 30.

Figure 5:
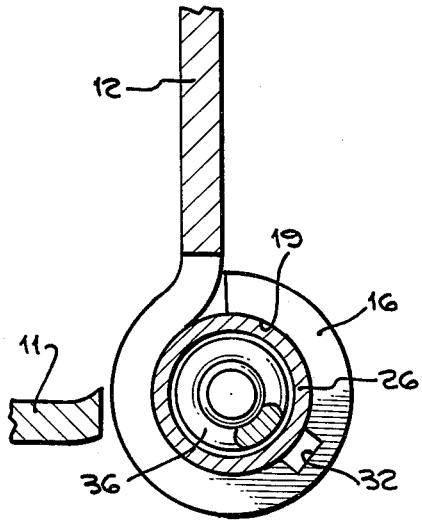
FIG. 5 is a cross sectional view on the line 5—5 of FIG. 4.

The lower knuckle 16 has a similar groove 32, as shown in FIG. 5, which is capable of aligning itself with the groove 31 only when the leaf hinges 11 and 12 are rotated to the positions of FIGS. 5 and 6, which is substantially in excess of a 180° spread which is the normal spread for the leaf hinges when mounted on a door with a door swung to full open position as shown in FIG. 7. The leaf hinges of course can be moved to the position of FIGS. 5 and 6 prior to attachment to the door and its frame. In that position the pintle 13 can be inserted upwardly first through the chamber 19 in the lower knuckle 16 with the rib 30 sliding through the groove 32 and continuing upwardly with the pintle being projecting through the chamber 17 while the rib 30 slides into the groove 31. Full insertion is accomplished when the pintle is extended upwardly into the chamber 18 in the upper knuckle 15, which has no groove. At this point the projecting rib 30 is contained entirely within the groove 31. The leaf hinges can then be rotated in a reverse direction, namely toward each other and ultimately to the positions of FIGS. 2 and 7 for example. Once the leaf hinges have been rotated out of the extreme position of FIGS. 5 and 6 the grooves 31 and 32 will no longer be in alignment and hence pintle 13 is locked in position.

The hinge is now ready for attachment to the door and to the frame. As previously noted the male leaf hinge 11 is shown attached to the door 25 as shown advantageously in FIG. 7 and the female leaf hinge 12 is attached to the door frame 23. From the position of FIG. 7, the door 25 cannot be swung any further open and as a consequence in this position the pintle cannot be dislodged. When the door is swung to the closed position of FIG. 2 the grooves 31 and 32 continue to be out of alignment and accordingly when the door is closed the pintle continues to be locked in place and cannot be removed. The only way in fact for the pintle to be removed is for the leaf hinges to be removed respectively from the door and frame.

When the pintle 13 is to have the construction of a composite pintle provided with a spring motor, details of which are enclosed in copending application Ser. No. 730,341 filed Oct. 7, 1976, of which this is a continuation in part, engagement of the rib 30 with the groove 31 in the central knuckle serves as the means for attaching that portion of the pintle to one of the leaf hinges mainly the leaf hinge 11. For attaching the composite pintle to the leaf hinge 12 there are provided serations 35 which can be driven into contact with the wall of the chamber 19 in the lower knuckle 16. As a consequence energy can be stored in a torsion coiled spring 36. This is made possible by securing one end of the spring to a tapered projection 37 of a lower end piece 34 carrying the serations 35 and the other end to a tapered projection 38 on a connecting member 41 attached to an upper end piece 39 by ratchet teeth 45. Energy built up in the torsion spring when the door is swung to the open position of FIG. 7 will act to return the door to the closed position of FIG. 2.

The upper end piece 39 is anchored to the tubular housing 26 by some appropriate conventional means as for example a set screw 40. Tension in the spring 36 can be varied by rotation of the connecting member 41 which carries the projection 38 by insertion of an appropriate tool (not shown) through an aperture 43 in the upper end piece 39 into a socket 44 in the connecting member 41 with the ratchet teeth 45 being employed to hold the adjustment.

Having described the invention, what is claimed as new in support of Letters Patent is as follows:

1. A hinge assembly comprising a pair of hinge leaves having knuckles on the respective leaves in axial alignment, each knuckle having a chamber in axial alignment with the chamber in the other knuckle, said leaves having collapsed positions, normal extended positions, and positions in excess of said normal extended positions, a unitary self contained pintle subassembly adapted for reception in said chambers to serve as a pivot for said hinge assembly, said pintle subassembly comprising a tubular housing having a length not less than the aggregate length of adjacent knuckles and extending throughout said aggregate length, said tubular housing providing interior space for a spring motor, a keying rib attached to and extending axially along the exterior of said tubular housing at a location intermediate opposite ends, a groove in each of the knuckles, the groove in one of said knuckles being open at both ends and the groove in the other knuckle being open at only one end, said grooves being in axial alignment with each other only when the leaves of the hinge are rotated to positions in excess of said normal extended positions to enable insertion of the pintle into the chambers and the accompanying rib into the grooves of the respective knuckles, said grooves being out of alignment in all other positions of the leaves whereby to inhibit removal of the pintle.

2. A hinge assembly as in claim 1 wherein there are two knuckles on one hinge leaf and a third knuckle on the other hinge leaf located between said first two identified knuckles, the chambers in one of said first two knuckles and the third knuckle having grooves extending therethrough and the chamber in the other of the first two knuckles being without a groove whereby to form a closed end for the groove in the third knuckle, said pintle subassembly having a length in excess of the aggregate length of the third knuckle and a knuckle of said one hinge leaf having the two knuckles.

3. A hinge assembly as in claim 1 wherein the rib has a length substantially equal to the length of the chamber which has only one open end.

4. A hinge assembly as in claim 1 wherein the pintle has an end piece and a rotatable connection between said end piece and said tubular housing, said end piece being located in the knuckle which has the groove open at both ends and including anchor means adapted to anchor said end piece to the respective knuckle.

5. A hinge assembly as in claim 4 wherein there is a spring motor in the tubular housing having ends in operating engagement with respectively the tubular housing and the end piece whereby to bias one hinge leaf rotatably relative to the other.

6. A hinge assembly as in claim 5 wherein there is means in the pintle exposed with respect to the exterior of the tubular housing and the knuckles for changing tension in the spring motor when the end piece is anchored to the knuckle and the hinge assembly is in mounted position.

7. A hinge assembly as in claim 4 wherein said anchor means comprises a circumferential distribution of teeth on said pintle subassembly having a press fit engagement with one of the knuckles.

* * * * *